US005136272A

United States Patent [19]

Kormann et al.

[11] Patent Number: 5,136,272

[45] Date of Patent: Aug. 4, 1992

[54] CERAMIC COMPONENT HAVING A PLURALITY OF IMPROVED PROPERTIES AND PROCESS FOR THE PRODUCTION OF SUCH A COMPONENT

[75] Inventors: René A. Kormann, Le Plessis Robinson; Raymond Loiseau, Saclay, both of France

[73] Assignee: Thomson-CSF, Puteaux, France

[21] Appl. No.: 543,786

[22] PCT Filed: Dec. 1, 1989

[86] PCT No.: PCT/FR89/00625

§ 371 Date: Jul. 24, 1990

§ 102(e) Date: Jul. 24, 1990

[30] Foreign Application Priority Data

Dec. 6, 1988 [FR] France ..... 88 15957

[51] Int. Cl.[5] ..... H01P 1/08

[52] U.S. Cl. ..... 333/252; 501/127; 501/153; 501/120; 156/108; 264/65

[58] Field of Search ..... 501/127, 120, 153; 156/108; 264/65; 333/252

[56] References Cited

U.S. PATENT DOCUMENTS

| | | | |
|---|---|---|---|
| 3,156,892 | 11/1964 | Bondley | 333/252 |
| 3,387,237 | 6/1968 | Cook . | |
| 3,516,839 | 6/1920 | Bruch | 501/153 |
| 3,905,845 | 9/1925 | Kobayashi et al. | 501/153 X |
| 4,031,177 | 6/1977 | Auriol et al. | 501/153 X |
| 4,373,030 | 2/1983 | Kaneno et al. | 501/153 X |
| 4,543,346 | 9/1985 | Matsui et al. | 501/153 X |
| 4,584,151 | 4/1986 | Matsui et al. | 501/153 X |
| 4,629,593 | 12/1986 | Groh et al. | 501/153 X |
| 4,684,908 | 8/1987 | Kuntzmann et al. | 333/252 |
| 4,688,009 | 8/1987 | Ferguson et al. | 333/252 |
| 4,720,471 | 1/1988 | Ando . | |
| 4,762,655 | 8/1988 | Rhodes et al. | 501/153 X |
| 4,983,555 | 1/1991 | Roy et al. | 501/153 X |

FOREIGN PATENT DOCUMENTS

| | | |
|---|---|---|
| 0153541 | 9/1985 | European Pat. Off. . |
| 1155795 | 5/1955 | France . |
| 0248958 | 12/1987 | France . |
| 2071073 | 9/1981 | United Kingdom . |

OTHER PUBLICATIONS

Treatise on Materials Science and Technology, vol. 9 Ceramic Fabrication Processes 1976.

Delaunay et al., "Mechanisms of Adherence of Alumina Scale Development During High-Temperature Oxidation of Fe-Ni-Cr-Al-Y Alloys" J. of Mat. Sci. 17 (1982) 2027-2036.

Ceramic Engineering and Science Proceedings, vol. 4, No. 7/8 Jul.-Aug. 1983, D. W. Roy et al.: "Polycrystalline $MgAl_2O_4$ spinel for high temperature windows" pp. 502-509.

INTERNATIONAL JOURNAL OF ELECTRONICS, vol. 64, No. 1, Jan. 1988, R. Heidinger: "Ceramic materials for microwave windows", pp. 37-48.

*Primary Examiner*—Karl Group

*Attorney, Agent, or Firm*—Oblon, Spivak, McClelland, Maier & Neustadt

[57] ABSTRACT

The process of the invention consists in co-sintering a fine-grain alumina (8,9,10) with a metallizable alumina (11,12). The component obtained has dielectric properties which are homogeneous in its useful part (8,9,10) and its metallizable parts (11,12) permitting the assembly thereof very solidly with metallic components (1).

15 Claims, 1 Drawing Sheet

Figure 1:
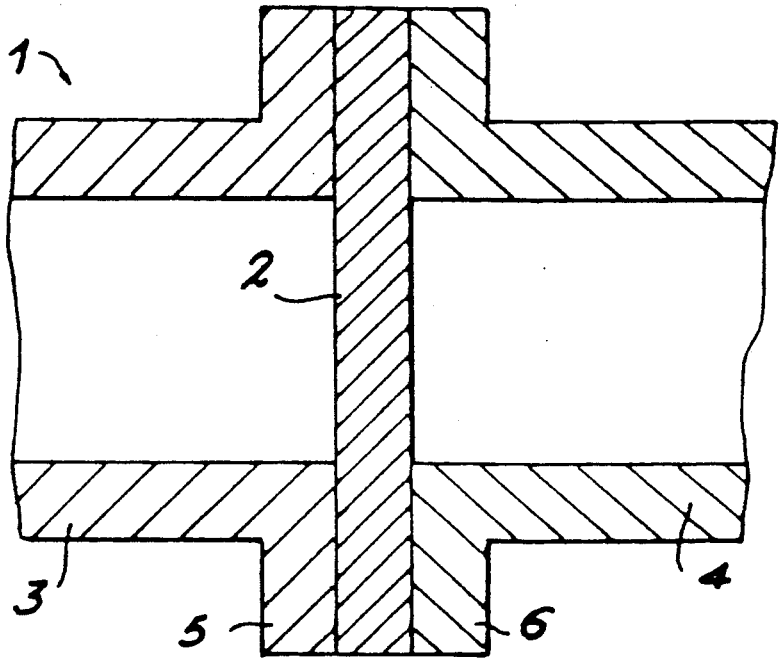

CERAMIC COMPONENT HAVING A PLURALITY OF IMPROVED PROPERTIES AND PROCESS FOR THE PRODUCTION OF SUCH A COMPONENT

The present invention relates to a ceramic component having a plurality of improved properties and to a process for the production of such a component.

Power millimeter and centimeter waves (power exceeding a few watts) are used especially in telecommunications and radars, but there is another application in which high powers are required this is the heating of the plasma of a thermonuclear fusion reactor. In such an application, powers exceeding a few megawatts are required.

These high powers are generated in vacuum tubes gyrotron, klystron, magnetron . . . ). Their principle of operation is in all cases the same: an electron gaining (or losing) velocity absorbs (or emits) electromagnetic energy. It is therefore sufficient to locate on the path of an electron beam a magnetic and electric field in a judicious manner in order that an electromagnetic wave should be generated. As this wave is created under vacuum, it is necessary to cause it to pass through a window in order to use it in an electronic circuit.

This window must be both transparent to the electromagnetic waves and sealed against gases (a vacuum of the order of $10^{-8}$ torr must be capable of being withstood steadily for a period of about ten years).

The windows which are currently employed on microwave tubes are made of metallizable alumina sintered under load (H.P.). The expression "metallizable alumina" is understood as referring to a material on which an appropriately braised small plate of metal has a resistance to tearing off exceeding 300 kg/cm$^2$. It contains 94 to 98% of alumina, the remainder being most frequently oxides of molybdenum, of manganese or of silicon. The grains of this material frequently have the particular feature of being very large (dimensions exceeding 10 microns).

Although the actual mechanism of strengthening of the adhesion is not yet entirely clear, the metallizable aluminas form part, and this is their strength, of the materials exhibiting the greatest values of resistance to tearing off: values as high as one tonne per square centimeter have been obtained.

However, in the aforementioned application, this metallizable alumina exhibits certain disadvantages:

It is in two phases, that is to say that it is composed of alumina grains separated from one another by a vitreous (non-crystalline) phase. These two materials have differing dielectric constants; this may locally deform the electric field lines and induce breakdowns. Furthermore, they have differing coefficients of expansion; the effect of this, in the event of a local increase in temperature, is to generate incipient cracks.

By reason of its poor dielectric losses, the vitreous phase contributes to absorbing a small part of the The grains are very large (10–50 μm); the result of this is to diminish the mechanical strength as compared with a fine-grain (1 μm) ceramic.

The subject of the present invention is a ceramic component exhibiting a coefficient of expansion and a dielectric constant which are virtually constant in a part of the volume of the component, this component having low dielectric losses and a very good mechanical strength.

The subject of the invention is also a window of the aforementioned type, which may be metallized while still being homogeneous and transparent to the electromagnetic waves, and effecting virtually no modifications to the lines of the field passing through it.

The subject of the invention is likewise a process for the production of such a component and of such a window.

The component according to the invention comprises a metallizable ceramic co-sintered with a material having properties which are homogeneous at the microscopic level, these properties being properties which are physical, especially dielectric, and/or chemical and/or mechanical.

The window according to the invention comprises at least one central part made of fine-grain ceramic, co-sintered with annular parts made of metallizable ceramic.

The production process according to the invention consists in casting, on the one hand, a slip based on ceramic powder and additives preventing the growth of the grains, and, on the other hand, in casting another slip based on ceramic power and additives promoting the adhesion of the metallizations, in cutting out to the desired dimensions the raw sheets obtained from these slips, in thermobonding at least one component obtained from one of the slips with at least one component obtained from the other slip, and in sintering the thermobonded assembly.

Figure 2:
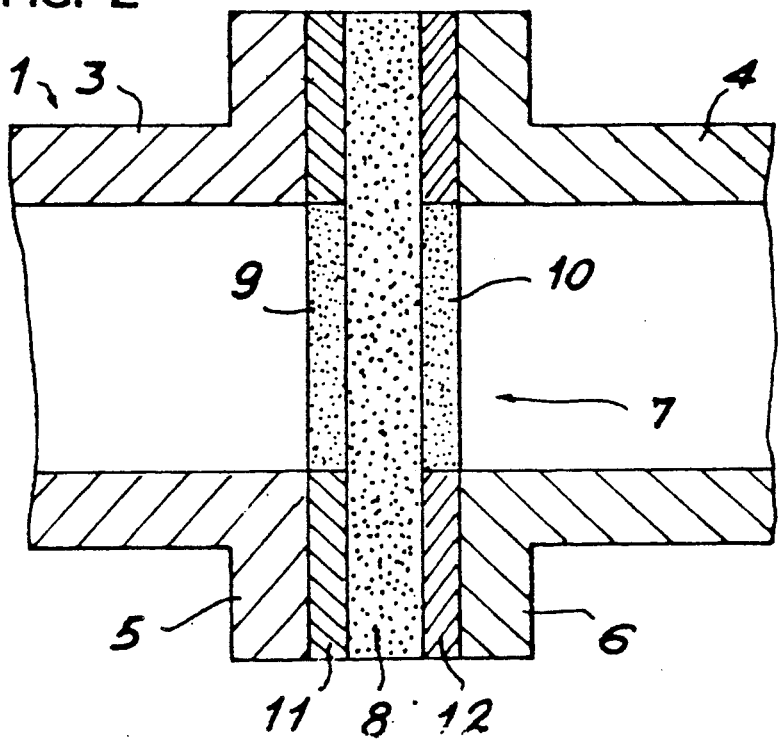

The present invention will be better understood on reading the detailed description of an embodiment taken as a non-limiting example and illustrated by the accompanying drawing, in which:

FIG. 1 is a longitudinal cross-sectional view of a waveguide part comprising a window of the prior art, and FIG. 2 is a longitudinal cross-sectional view of a waveguide part comprising a window according to the invention.

The invention is described herein below with reference to the construction of a window for a microwave generator tube, but it is clearly understood that it is not limited to such an application and that it may be implemented in numerous other fields where there is a need for ceramic components exhibiting, in a part of their volume, homogeneous properties and, in another part, in general peripheral or at the surface, a metallizable structure.

FIG. 1 shows a waveguide part 1, which is, for example, the exit of a millimeter or centimeter wave generator (not shown) such as a gyrotron, a klystron or a magnetron. It is assumed that the waveguide has a circular cross-section.

The waveguide 1 is hermetically sealed by a window 2. In order to fix the window 2, the waveguide has been constructed in two sections 3,4 each ending in a collar 5,6 respectively. The window 2 is bonded between the two collars 5,6. This known window 2 is a plate, in the form of a thick disc, made as a single component of metallizable ceramic, and exhibits the disadvantages referred to hereinabove.

The window 7 according to the invention is represented in FIG. 2. It is likewise bonded between the collars 5,6 of the sections 3,4 of the waveguide 1.

The window 7 is made of a composite material formed of a plurality of parts. The central part 8 of the window 7, which is made of fine-grain ceramic having a high degree of purity (for example 99%) has a thick disc shape, the diameter of which is virtually equal to the external diameter of the collars 5,6.

A disc 9,10 respectively is disposed on each face of the disc 8. The discs 9,10 are constructed with the same material as is the disc 8. These discs 9,10 are coaxial with the disc 8, but their diameter is virtually equal to the internal diameter of the guide 1.

The discs 9,10 are each surrounded by a ring of metallizable ceramic 11,12 respectively. The rings 11,12 are disposed on the two faces of the disc 8, coaxially with the latter. These rings 11,12 have substantially the same thickness as the discs 9,10. Their internal diameter is virtually equal to the diameter of the discs 9,10, and their external diameter virtually equal to the external diameter of the collars 5,6.

The various parts 8 to 12 of the window 7 are advantageously produced, then co-sintered according to the process described in detail hereinbelow, which is applicable to all the composite ceramic components according to the invention.

A preferred example of production of the parts 8 to 12 is described hereinbelow, but it is clearly understood that other well-known processes of production may be implemented.

According to the present illustrative embodiment, the various components are formed by casting of a slip, in accordance with the well-known "doctor blade" process. The slip is prepared by dispersing ceramic powder into an organic solvent (for example trichloroethylene or ethylalcolol with the aid of a defloculant (for example Menhaden oil), while adding a binder which is soluble in this solvent (for example polyvinyl butyral). In order to impart the raw sheet a certain flexibility facilitating its use, a plasticizer (for example polyethylene glycol) is advantageously added.

After casting and evaporation of the solvent, the raw sheet obtained has all the properties required in order to be handled and cut out without damage.

In order to produce the parts 8,9,10 of the window 7, casting takes place of an ultrapure ceramic powder (purity better than 99%), for example ultrapure alumina, supplemented by less than approximately 1% by weight of an additive preventing the growth of the grains, for example MgO.

In order to produce the parts 11,12 of the window 7, casting likewise takes place of an ultrapure ceramic powder, for example ultrapure alumina, supplemented by additives promoting the adhesion of the metallizations, for example at least one of the following bodies: silica, magnesia, manganese oxide, molybdenum oxide, niobium oxide, calcium oxide and titanium oxide.

After casting, each one of the two raw bands (which have the appearance of a flexible plastic material) is cut out in an appropriate manner: the first for the parts 8,9 and 10, and the second for the parts 11 and 12. The parts cut out are assembled and pressed together at a high pressure (for example 400 bars) and at a temperature of approximately 90° C. in such a manner as to thermobond them together. The thermobonded component (thus comprising the parts 8 to 12) is placed in a furnace in order to be sintered therein. An example of heat treatment in this furnace is the following. The temperature is increased to 600° C. at the rate of approximately 100° C./hour, and then this temperature of approximately 600° C. is maintained for two hours, and then the temperature is increased to the sintering temperature, which is generally within the range between approximately 1400° and 1800° C., at the rate of approximately 100° C./hour. When the appropriate sintering temperature has been reached, it is maintained for a few hours (approximately between 1 and 10 hours), and finally reversion takes place to ambient temperature at the rate of approximately −150° C./hour.

The fact of starting from one and the same alumina powder for the two mixtures of powders of the slips offers the advantage of having a temperature and an amplitude of withdrawal which are substantially identical in the various parts of the composite component (the window 7 for the present example); this avoids any deformation of the composite component. The secondary effect of the heat treatment is to cause enlargement of the grains of the metallizable alumina as compared with the alumina of the window per se (8,9,10).

It is, of course, possible to use other ceramics, for example spinel ($MgAl_2O_4$), in place of alumina.

The shrinkages are adjusted by varying the composition of the metallizable ceramic, the particle size of the powders and the sintering conditions.

We claim:

1. A ceramic window component which is transparent to electromagnetic waves, comprising:

a disc-shaped alumina or spinel ceramic central window having two planar surfaces perpendicular to an axis in the thickness direction, and two annular rings of a metallizable alumina or spinel ceramic containing a metallization promoting additive selected from the group consisting of silica, magnesia, manganese oxide, molybdenum oxide, niobium oxide, calcium oxide and titanium oxide co-sintered to said planar surfaces.

2. The ceramic component according to claim 1, wherein said ceramic is alumina.

3. The ceramic component according to claim 1, wherein said ceramic is spinel.

4. The ceramic component according to claim 1, wherein said metallizable ceramic is alumina.

5. The ceramic component according to claim 1, wherein said metallizable ceramic is spinel.

6. The ceramic component of claim 1, wherein the external diameter of said annular rings is substantially equal to the external diameter of said central window.

7. The ceramic component of claim 1, further comprising two disc-shaped outer windows of said ceramic co-sintered to said planar surfaces about said axis, wherein the external diameter of said outer windows is substantially equal to the internal diameter of said annular rings.

8. A ceramic window component on a wave guide, comprising:

a wave guide having a longitudinal axis, a disc-shaped alumina or spinel ceramic central window having two planar surfaces perpendicular to said axis, and two annular rings of a metallizable alumina or spinel ceramic containing a metallization promoting additive selected from the group consisting of silica, magnesia, manganese oxide, molybdenum oxide, niobium oxide, calcium oxide and titanium oxide co-sintered to said planar surfaces.

9. A process for producing a ceramic window component, comprising the steps of:

casting a ceramic slip containing a grain growth preventing additive to form a cast ceramic sheet and removing a disc-shaped central window having two planar surfaces perpendicular to an axis in the thickness direction of said window from said cast sheet, casting a ceramic slip containing a metalization promoting adhesive to form a cast ceramic sheet and removing annular rings from said cast sheet, placing said annular rings on each of said planar surfaces of said central window about said axis, thermobonding said rings and said window, and co-sintering said thermobonded rings and central window to form said ceramic window component.

10. The process of claim 9, wherein said grain growth promoting additive is MgO.

11. The process of claim 9, wherein said metalization promoting additive comprises at least one member selected from the group consisting of silica, magnesia, manganese oxide, molybdenum oxide, niobium oxide, calcium oxide and titanium oxide.

12. The process of claim 9, wherein said ceramic slip comprises alumina.

13. The process of claim 9, wherein said ceramic slip comprises spinel.

14. The process of claim 9, wherein said thermo bonding is carried out at a pressure of approximately 400 bars and at a temperature of approximately 90° C.

15. The process of claim 9, wherein said co-sintering is carried out at a temperature within the range of about 1400°-1800° C.

* * * * *